US006830432B1

(12) United States Patent
Scott et al.

(10) Patent No.: US 6,830,432 B1
(45) Date of Patent: Dec. 14, 2004

(54) COOLING OF COMBUSTION TURBINE AIRFOIL FILLETS

(75) Inventors: Robert Kenmer Scott, Geneva, FL (US); Joseph Theodore Tapley, Winter Springs, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/603,036

(22) Filed: Jun. 24, 2003

(51) Int. Cl.[7] ..... F01D 5/18

(52) U.S. Cl. ..... 416/97 R; 416/193 A; 415/115

(58) Field of Search ..... 415/115; 416/97 R, 416/193 A

(56) References Cited

U.S. PATENT DOCUMENTS

| | | | | |
|---|---|---|---|---|
| 2,746,672 A | | 5/1956 | Doll, Jr. et al. | |
| 2,801,790 A | | 8/1957 | Doll, Jr. | |
| 3,971,586 A | | 7/1976 | Saunders | |
| 4,439,104 A | | 3/1984 | Edmonds | |
| 4,834,611 A | | 5/1989 | Meng | |
| 5,088,892 A | | 2/1992 | Weingold et al. | |
| 5,181,830 A | | 1/1993 | Chou | |
| 5,209,644 A | | 5/1993 | Dorman | |
| 5,340,278 A | * | 8/1994 | Magowan | 416/96 R |
| 5,363,705 A | | 11/1994 | Nakao et al. | |
| 5,382,135 A | * | 1/1995 | Green | 416/97 R |
| 5,486,091 A | | 1/1996 | Sharma | |
| 5,947,683 A | | 9/1999 | Kobayashi | |
| 5,975,851 A | | 11/1999 | Liang | |
| 6,036,438 A | | 3/2000 | Imai | |
| 6,079,948 A | | 6/2000 | Sasaki et al. | |
| 6,186,445 B1 | | 2/2001 | Batcho | |
| 6,190,128 B1 | | 2/2001 | Fukuno et al. | |
| 6,283,713 B1 | | 9/2001 | Harvey et al. | |
| 6,382,908 B1 | * | 5/2002 | Keith et al. | 415/115 |
| 6,398,486 B1 | | 6/2002 | Storey et al. | |
| 6,419,446 B1 | | 7/2002 | Kvasnak et al. | |
| 6,481,967 B2 | | 11/2002 | Tomita et al. | |

FOREIGN PATENT DOCUMENTS

| | | |
|---|---|---|
| JP | 52-74706 | 6/1977 |
| JP | 59-115500 A | 7/1984 |
| JP | 5-272444 A | 10/1993 |
| SU | 646095 | 2/1979 |

OTHER PUBLICATIONS

T. I–P. Shih and Y.–L. Lin. Controlling Secondary–Flow Structure by Leading–Edge Airfoil Fillet and Inlet Swirl to Reduce Aerodynamics Loss and Surface Heat Transfer. Proceedings of ASME Turbo Expo 2002, Jun. 3–6, 2002, Amsterdam, The Netherlands. GT–2002–30529.

* cited by examiner

*Primary Examiner*—Ninh H. Nguyen

(57) ABSTRACT

A turbine fluid guide member (10) including an airfoil portion (12), a platform portion (14) and fillet (16) joining the airfoil portion to the platform portion. Fillet cooling holes **(18*a*–18*f*) are positioned in the turbine fluid guide member relative to a pressure side vortex flow (22) so that a cooling fluid flow (20) exiting the hole is directed to form a cooling film (32)** over the fillet. The cooling holes may be positioned in the airfoil portion, the platform portion, or any combination thereof, depending on the geometry of the airfoil and resultant vortex flows around the airfoil. A method of cooling a fillet of the turbine fluid guide member may include identifying a vortex flow around the fillet and selectively positioning a hole relative to the vortex flow such that a cooling fluid flow exiting the hole is directed to form a cooling film over the fillet.

10 Claims, 2 Drawing Sheets

COOLING OF COMBUSTION TURBINE AIRFOIL FILLETS

FIELD OF THE INVENTION

This invention relates generally to combustion turbine engines, and, in particular, to cooling of turbine fluid guide members.

BACKGROUND OF THE INVENTION

In a typical combustion turbine engine, a variety of vortex flows are generated around airfoil elements within the turbine. FIG. 1 is a perspective view of a cut-away of several turbine airfoil portions 1 showing hot combustion fluid flow 3 around the airfoil portions 1. It is known that "horseshoe" vortices, including a pressure side vortex 4, and a suction side vortex 5, are formed when a hot combustion fluid flow 3 collides with the leading edges 6 of the airfoil portions 1. The vortices 4,5 are formed according to the particular geometry of the airfoil portions 1, and the spacing between the airfoil portions 1 mounted on the platform 2. As the hot combustion fluid flow 3 splits into the pressure side vortex 4 and a suction side vortex 5, the vortices 4,5 rotate in directions that sweep downward from the respective side of the airfoil portion 1 to the platform 2. On the pressure side 8 of the airfoil portions 1, the pressure side vortex 4 is the predominant vortex, sweeping downward as the pressure side vortex 4 passes by the airfoil portion 1. As shown, the pressure side vortex 4 crosses from the pressure side 8 of the airfoil portion 1 to the suction side 7 of an adjacent airfoil portion 1. In addition, the pressure side vortex 4 increases in strength and size as it crosses from the pressure side 8 to the suction side 7. Upon reaching the suction side 7, the pressure side vortex 4 is substantially stronger than the suction side vortex 5 and is spinning in a rotational direction opposite from the suction side vortex 5. On the suction side 7, the pressure side vortex 4 sweeps up from the platform 2 towards the airfoil portion 1. Consequently, because the pressure side vortex 4 is substantially stronger that the suction side vortex 5, the resultant, or combined flow of the two vortices 4, 5 along the suction side 7 is radially directed to sweep up from the platform 2 towards the airfoil portion 1.

A conventional approach to cooling fluid guide members, such as airfoils in combustion turbines, is to provide cooling fluid, such as high pressure cooling air from the intermediate or last stages of the turbine compressor, to a series of internal flow passages within the airfoil. In this manner, the mass flow of the cooling fluid moving through passages within the airfoil portion provides backside convective cooling to the material exposed to the hot combustion gas. In another cooling technique, film cooling of the exterior of the airfoil can be accomplished by providing a multitude of cooling holes in the airfoil portion to allow cooling fluid to pass from the interior of the airfoil to the exterior surface. The cooling fluid exiting the holes form a cooling film, thereby insulating the airfoil from the hot combustion gas. While such techniques appear to be effective in cooling the airfoil region, little cooling is provided to the fillet region where the airfoil is joined to a mounting platform.

The fillet region is important in controlling stresses where the airfoil is joined to the platform. Although larger fillets can lower stresses at the joint, such as disclosed in U.S. Pat. No. 6,190,128, the resulting larger mass of material is more difficult to cool through indirect means. Accordingly, prohibitively large amounts of cooling flow may need to be applied to the region of the fillet to provide sufficient cooling. If more cooling flow for film cooling is provided to the airfoil in an attempt to cool the fillet region, a disproportionate amount of cooling fluid may be diverted from the compressor system, reducing the efficiency of the engine and adversely affecting emissions. While forming holes in the fillet to provide film cooling directly to the fillet region would improve cooling in this region, it is not feasible to form holes in the fillet because of the resulting stress concentration that would be created in this highly stressed area.

Backside impingement cooling of the fillet region has been proposed in U.S. Pat. No. 6,398,486. However, this requires additional complexity, such as an impingement plate mounted within the airfoil portion. In addition, the airfoil portion walls in the fillet region are generally thicker, which greatly reduces the effectiveness of backside impingement cooling.

Accordingly, there is a need for improved cooling in the fillet regions of turbine guide members.

SUMMARY OF THE INVENTION

A turbine fluid guide member is described herein as including: an airfoil portion; a platform portion; and a fillet joining the airfoil portion to the platform portion. The turbine fluid guide member also includes a coolant outlet positioned remotely from the fillet such that a cooling flow exiting the outlet is directed by a vortex flow to form a cooling film over the fillet. In addition, the turbine fluid guide member may include a plurality of holes formed in the airfoil directing a coolant flow into a vortex flow to create a cooling film along a portion of the fillet on the pressure side. The turbine fluid guide member may also include another plurality of holes formed in the platform directing the coolant flow into a vortex flow to create another cooling film along a portion of the fillet on the suction side.

A combustion turbine engine is described herein as including: a compressor; a turbine; a combustor; and a turbine fluid guide member. The turbine fluid guide member also includes an airfoil portion, a platform portion, a fillet joining the airfoil portion to the platform portion, and a coolant outlet positioned remotely from the fillet such that a cooling flow exiting the outlet is directed by a vortex flow to form a cooling film over the fillet.

A method for cooling a portion of a turbine fluid guide member is described herein as including: identifying a vortex flow around the turbine fluid guide member; and selectively positioning a coolant outlet relative to the vortex flow such that a cooling flow exiting the outlet is directed by the vortex flow to form a cooling film over a fillet portion of the turbine fluid guide member.

BRIEF DESCRIPTION OF THE DRAWINGS

These and other advantages of the invention will be more apparent from the following description in view of the drawings that show.

DETAILED DESCRIPTION OF THE INVENTION

Figure 2:
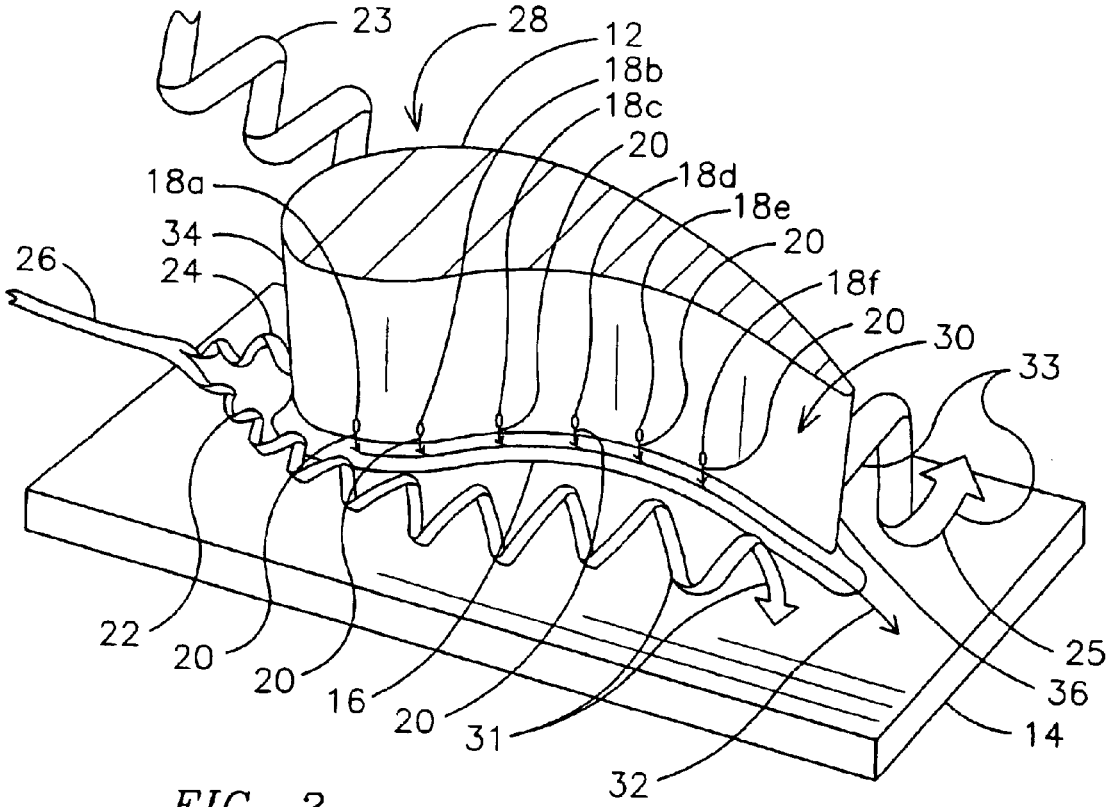
FIG. 2 is a perspective view of a cut-away turbine airfoil portion with attached platform showing hot combustion fluid flow around the airfoil portion and cooling flows exiting fillet cooling holes in the airfoil portion.

FIG. 2 illustrates a cut away portion of a turbine fluid guide member 10 having an airfoil portion 12, a platform portion 14 and a fillet 16 joining the airfoil portion 12 to the platform portion 14. In one aspect of the invention, the airfoil portion 12 may be a stationary vane, and, in another aspect, the airfoil portion 12 may be a rotating blade. For the purposes of this invention, platform portion 14 is intended to refer to the structure to which the airfoil portion 12 is mounted. For example, in a rotating blade embodiment, the platform portion 14 can be a platform, and in a stationary vane embodiment, the platform portion 14 can be the vane shroud.

Figure 1:
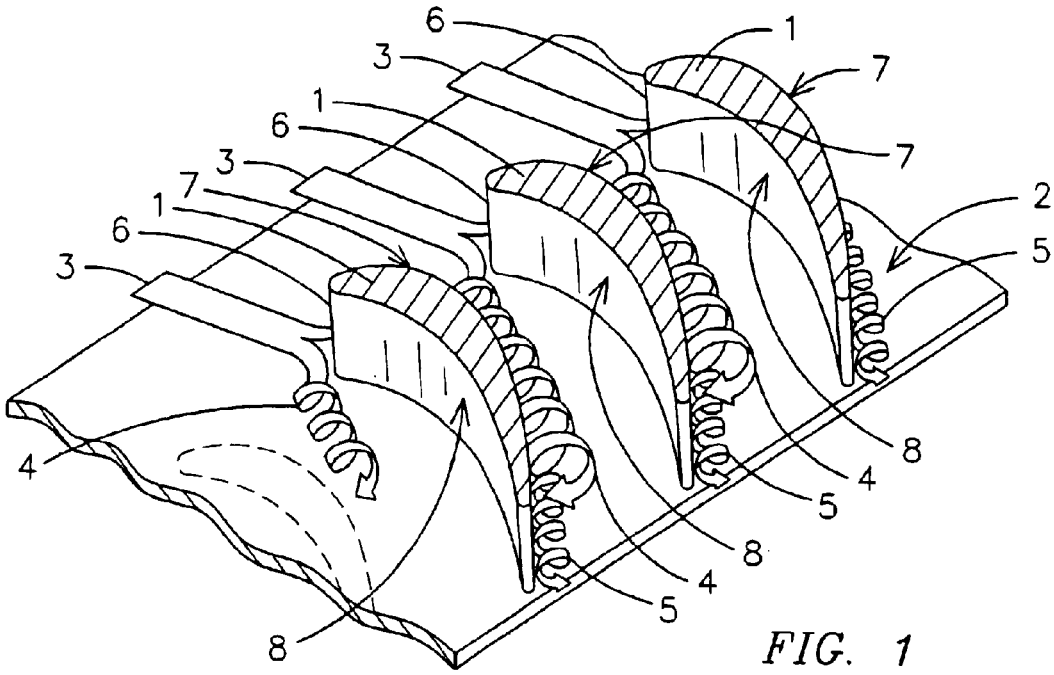
FIG. 1 PRIOR ART
FIG. 1 is a perspective view of a cut-away of several turbine airfoil portions showing hot combustion fluid flow around the airfoil portions as known in the art.

As depicted in FIG. 2, a hot combustion fluid flow 26 flowing towards the airfoil portion 12, separates into suction side vortex flow 24 flowing around the airfoil portion 12 on a suction side 28 and a pressure side vortex flow 22 flowing around the airfoil portion 12 on a pressure side 30. In addition, as depicted in FIG. 1, another pressure side vortex flow 23 crosses from an adjacent airfoil portion (not shown) and flows along the airfoil portion 12 on the suction side 28. The pressure side vortex flow 23 may combine with the suction side vortex flow 24 to form a combined vortex flow 25. Experimental tests and simulations performed using computational fluid dynamic (CFD) analysis techniques can be used to analyze and predict such vortex flows 22, 23, 24, 25 depending on the airfoil portion 12 geometry and the spacing of airfoil portions 12 in relation to other airfoil portions 12. CFD software packages available from Fluent, Incorporated and AEA Engineering Technologies, Incorporated, for example, are useful for such an analysis. The vortex flows 22, 23, 24, 25 may take the form of multiple vortices of varying strength starting at the leading edge 34 of the airfoil portion 12 and continuing along the fillet 16 downstream past the trailing edge 36 of the airfoil portion 12. The pressure side vortex flow 22 may also have a radially directed component 31 flowing downwardly against the airfoil portion 12 towards the platform portion 14, as it flows longitudinally along the fillet 16 on the pressure side 30. On the suction side 28, the combined vortex flow 23 may have a radially directed component 33 flowing upwardly from the platform portion 14 against the airfoil portion 12 as it flows longitudinally along the fillet 16.

Advantageously, the present inventors have innovatively recognized that by directing a cooling fluid flow 20 into the vortex flows 22, 23, 24, 25 flowing adjacent to the fillet 16, improved cooling of the fillet 16 can be provided. For example, fillet cooling holes 18*a*–18*f* can be positioned in the airfoil portion 12 on the pressure side 30 relative to the pressure side vortex flow 22 so that cooling fluid flow 20 exiting the fillet cooling holes 18*a*–18*f* is injected into the pressure side vortex flow 22. As a result, the radial component 31 of the pressure side vortex flow 22 acts to direct the cooling fluid flow 20 downwards from the fillet cooling holes 18*a*–18*f*, towards the fillet 16, before being directed downstream in a longitudinal direction along the fillet 16. When the cooling fluid flow 20 from one hole, for example 18*a*, ceases to effectively cool the fillet 16, another fillet cooling hole, such as 18*b*, can be positioned to replenish the cooling fluid flow 20. This process may be continued longitudinally along the length of the airfoil portion, such as near the fillet 16, to the trailing edge, providing a continuous cooling fluid flow 20 to form a cooling film 32 over the fillet 16.

Accordingly, the inventors have realized that by controlling geometric parameters of the fillet cooling holes 18*a*–18*f*, such as location, orientation, angle with respect to an exit surface, diameter, hole geometry, spacing, and pressure drop between a hole inlet opening and exit opening, the holes 18*a*–18*f* can be configured to inject cooling fluid 20 into the pressure side vortex flow 22 so that a cooling film 32 is formed over the fillet 16, providing improved cooling of the fillet 16 compared to conventional techniques. It should be understood that the cooling hole positions depicted in FIG. 1 are provided as example positions. Cooling holes may be positioned anywhere along the length of the airfoil or platform, including the leading and trailing edges of the airfoil, provided that the position of the holes effectively couples cooling fluid exiting the holes to a secondary vortex to direct the cooling fluid to flow over the fillet to provide improved cooling of the fillet. For example, fluid flow simulations, such as CFD techniques, may be used to configure the shape, orientation, and positioning of cooling holes for fillet cooling in a desired airfoil geometry.

Figure 3:
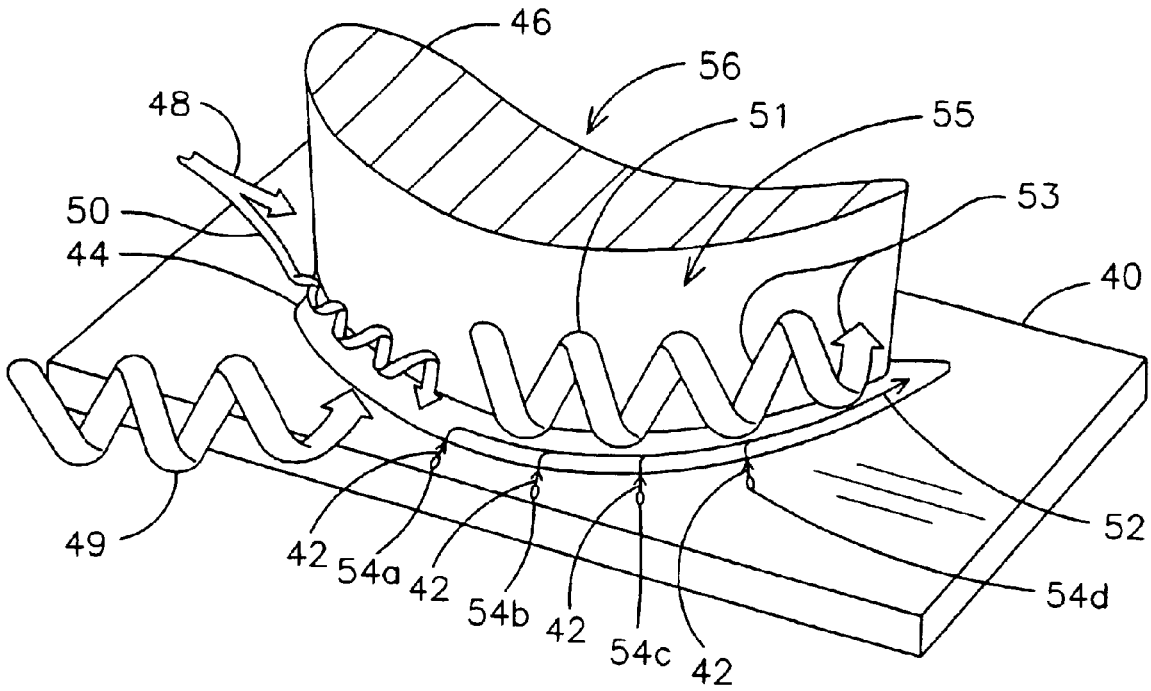
FIG. 3 is a perspective view of a cut-away turbine airfoil portion with attached platform showing hot combustion fluid flow around the airfoil portion and cooling flows exiting fillet cooling holes in the platform portion.

FIG. 3 is a perspective view of a turbine airfoil portion 46 showing hot combustion fluid flow around the airfoil portion 46 and cooling flows exiting fillet cooling holes 54*a*–54*d* in the platform 40. In another aspect of the invention, fillet cooling holes 54*a*–54*d* may be formed in the platform portion 40 to direct a cooling fluid flow 42 over the fillet 44. As is understood in the art, the three dimensional geometry of the airfoil portion 46, in combination with the attached platform portion 40, determines how the hot combustion fluid flow 48 flows around the airfoil portion 46 and creates a suction side vortex flow 50. Therefore, depending on the geometry of the airfoil portion 46, it may be beneficial to position the fillet cooling holes 54*a*–54*d* in the platform portion 40, so that optimum coupling of a cooling fluid flow 42 into the suction side vortex flow 50 and the combined vortex flow 51 for film cooling of the fillet 44 is provided. For example, the combined vortex flow 51 flowing adjacent to the fillet 44 on a suction side 55 may have a radially directed component 53 directed upwardly against the airfoil portion 46 from the platform portion 44.

By positioning fillet cooling holes 54*a*–54*d* in the platform portion 40 relative to the combined vortex flow 51 so that cooling fluid flow 42 exiting the fillet cooling holes 54*a*–54*d* is injected into the combined vortex flow 51, the radially directed component 53 of the combined vortex flow 51 acts to direct the cooling fluid flow 42 upwardly from the platform portion 40 towards the fillet 44 before being directed in a longitudinal direction downstream along the fillet 44, thereby establishing a cooling film 52 over the fillet 44. Similarly, fillet cooling holes (not shown) can be formed in the platform portion 40 adjacent to the pressure side 56 of the airfoil portion 46 to inject the cooling fluid flow into a pressure side vortex (not shown) flowing over the fillet 44 on the pressure side 56 as described in relation to FIG. 1. In yet another embodiment, fillet cooling holes may be formed in both the airfoil portion 46 and the platform portion 40, or any combination thereof, to provide optimum cooling of the fillet 44, depending on the nature of vortices flowing adjacent to the fillet 44.

Optimal positioning of fillet cooling holes to provide improved cooling of a fillet in a turbine fluid guide member will now be described. With the advent of high power computing capability, computation and simulation of fluid flows relative to complex geometries has recently become possible using CFD analysis. By taking advantage of the efficiencies offered by CFD analysis and simulation, various parameters regarding position of fillet cooling holes relative to secondary vortices can be analyzed to determine optimal positioning of the holes. The placement and orientation of the fillet cooling holes near the fillet is critical to the invention, and depends upon the strength and orientation of a secondary vortex flow flowing near the fillet cooling hole. If the cooling fluid exiting the fillet cooling holes is not effectively coupled to the secondary vortex, the cooling fluid may be directed directly downstream when exiting the holes, instead of flowing over the fillet before being directed downstream. If the vortex is too strong in the area of the cooling hole, the cooling fluid may be pulled past the fillet and form a cooling film over a different area before being directed downstream. In addition, different airfoil portion geometries will result in different vortex flows, so that placement of fillet cooling holes in one airfoil portion geometry may not be effective in a different airfoil portion geometry.

Advantageously, CFD techniques can be used in an iterative design approach to optimally configure the fillet cooling holes to establish a cooling film over the fillet. Generally, the design approach includes identifying a secondary vortex flow adjacent to the fillet and selectively positioning holes relative to the vortex flow, such that a cooling flow exiting the holes in an area remote from the fillet is directed to form a cooling film over the fillet. Using CFD techniques, a desired airfoil and platform geometry can be created, for example, using computer aided drawing (CAD) techniques, which can be transformed into a mesh, such as a finite element mesh or finite volume mesh, to serve as a model for input into the CFD software. Fillet cooling holes can be experimentally positioned in the model where the holes are most likely to direct the cooling fluid into an identified secondary vortex and over the fillet, based on a general knowledge of fluid dynamics. Flow conditions can then be simulated and various parameters of the simulation, such as fluid particle trajectories or contours of temperature, can be plotted with respect to the input geometry to determine the effectiveness of the hole positions in providing a cooling flow to the fillet. For example, a skilled artisan may use CFD techniques and temperature gradient plots provided by CFD simulations to determine the effectiveness of hole positioning for fillet cooling. Multiple iterations of simulating, repositioning fillet cooling holes in the model, and further simulating can be performed to achieve optimal positioning of the holes to provide cooling of the fillet.

Figure 4:
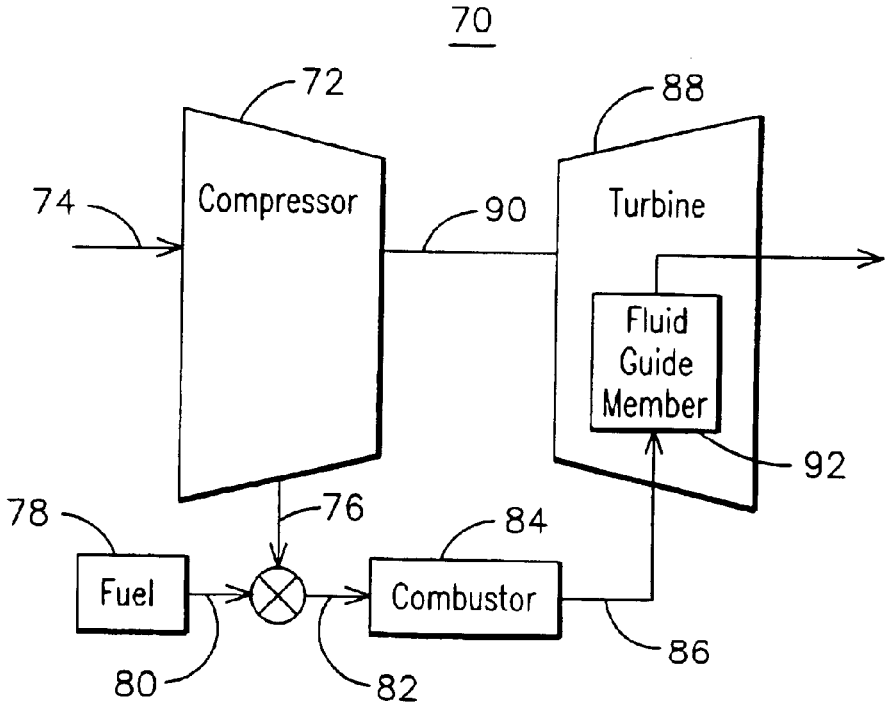
FIG. 4 is a functional diagram of a combustion turbine engine having a turbine including a fluid guide member of the current invention.

FIG. 4 illustrates a combustion turbine engine 70 having a compressor 72 for receiving a flow of filtered ambient air 74 and for producing a flow of compressed air 76. The compressed air 76 is mixed with a flow of a combustible fuel 80, such as natural gas or fuel oil for example, provided by a fuel source 78, to create a fuel-oxidizer mixture flow 82 prior to introduction into a combustor 84. The fuel-oxidizer mixture flow 82 is combusted in the combustor 84 to create a hot combustion gas 86.

A turbine 88, including a fluid guide member 92, receives the hot combustion gas 86, where it is expanded to extract mechanical shaft power. In an aspect of the invention, the fluid guide member 92 fillet is cooled using the techniques of providing fillet cooling holes coupled to secondary vortices as previously described. In one embodiment, a common shaft 90 interconnects the turbine 88 with the compressor 72, as well as an electrical generator (not shown) to provide mechanical power for compressing the ambient air 74 and for producing electrical power, respectively. The expanded combustion gas 86 may be exhausted directly to the atmosphere or it may be routed through additional heat recovery systems (not shown).

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A turbine fluid guide member comprising:

an airfoil portion;

a platform portion;

a fillet joining the airfoil portion to the platform portion; and a coolant outlet positioned remotely from the fillet such that a cooling flow exiting the outlet is directed by a vortex flow to form a cooling film over the fillet.

2. The turbine fluid guide member of claim 1, wherein the coolant outlet comprises a hole positioned in the airfoil portion proximate the fillet.

3. The turbine fluid guide member of claim 1, wherein the coolant outlet comprises a hole positioned in the platform portion proximate the fillet.

4. The turbine fluid guide member of claim 1, wherein the airfoil portion comprises a stationary vane.

5. The turbine fluid guide member of claim 1, wherein the airfoil portion comprises a rotating blade.

6. The turbine fluid guide member of claim 1, further comprising a plurality of spaced apart coolant outlets disposed longitudinally so that the cooling film is maintained below a predetermined temperature along a length of the fillet.

7. A turbine fluid guide member comprising:

an airfoil having pressure and suction sides;

a platform;

a fillet joining the airfoil to the platform;

a plurality of holes formed in the airfoil directing a coolant flow into a first vortex flow to create a first cooling film along a first portion of the fillet on a first one of the pressure and vortex sides.

8. The turbine guide member of claim 7, further comprising a plurality of holes formed in the platform directing the coolant flow into a second vortex flow to create a second cooling film along a second portion of the fillet on a second one of the pressure and suction sides.

9. A combustion turbine engine comprising:

a compressor;

a turbine;

a combustor; and a turbine fluid guide member comprising an airfoil portion, a platform portion, a fillet joining the airfoil portion to the platform portion, and a coolant outlet positioned remote from the fillet such that a cooling flow exiting the outlet is directed by a vortex flow to form a cooling film over the fillet.

10. A method for cooling a portion of a turbine fluid guide member comprising:

identifying a vortex flow around the turbine fluid guide member; and selectively positioning a coolant outlet relative to the vortex flow such that a cooling flow exiting the outlet is directed by the vortex flow to form a cooling film over a fillet portion of the turbine fluid guide member.

* * * * *